United States Patent [19]

Langenbach

[11] 4,006,961

[45] Feb. 8, 1977

[54] CONTACT RETENTION ASSEMBLY

[75] Inventor: Jack E. Langenbach, Newport Beach, Calif.

[73] Assignee: International Telephone and Telegraph Corporation, New York, N.Y.

[22] Filed: Feb. 25, 1976

[21] Appl. No.: 661,179

[52] U.S. Cl. ..... 339/217 S; 29/750; 29/764

[51] Int. Cl.[2] ..... H01R 13/42; H01R 43/00

[58] Field of Search ..... 339/217 S, 220, 221; 29/203 H, 206, 427

[56] References Cited

UNITED STATES PATENTS

| | | | |
|---|---|---|---|
| 3,368,185 | 2/1968 | Dell et al. | 339/217 S |
| 3,530,428 | 9/1970 | Zak | 339/217 S |
| 3,957,337 | 5/1976 | Damiano | 339/217 S |

*Primary Examiner*—Roy Lake
*Assistant Examiner*—Neil Abrams
*Attorney, Agent, or Firm*—Thomas L. Peterson

[57] ABSTRACT

A contact retention assembly in which a contact is mounted in a contact cavity in a connector insulator from the rear and is released from the front of the insulator to allow removal of the contact rearwardly from the cavity. The contact is formed with a laterally and rearwardly extending spring retention tine that extends across the contact cavity and engages the wall of the cavity to prevent rearward movement of the contact in the cavity. An aperture is provided in the contact in front of the tine. A tool is inserted from the front of the insulator into the aperture, and threaded therein so that the end of the tool will deflect the tine rearwardly, thereby releasing it from its engagement with the wall of the contact cavity. The contact is then free to be removed rearwardly from the cavity.

3 Claims, 8 Drawing Figures

FIG. 1
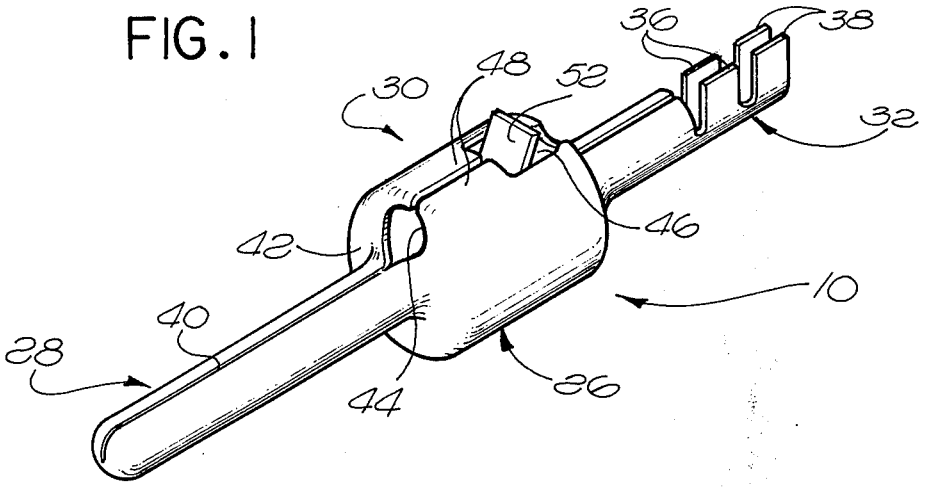
FIG. 2
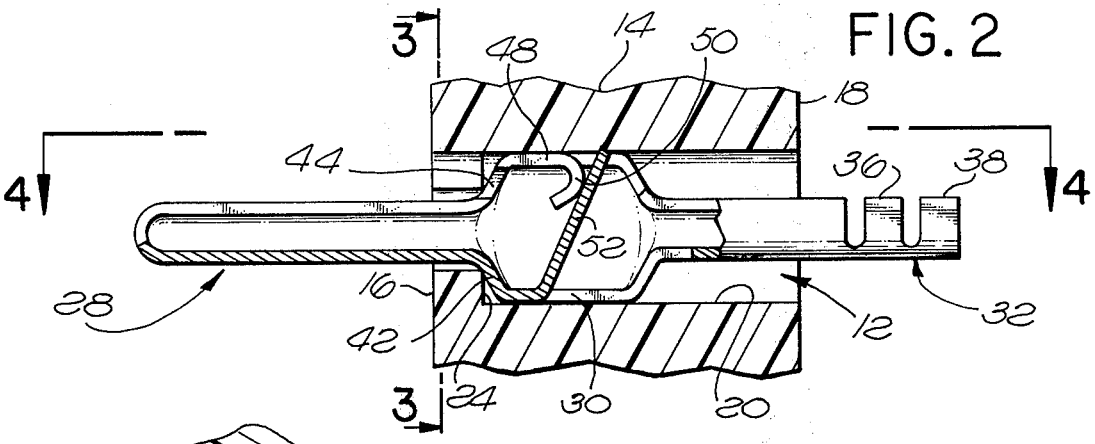
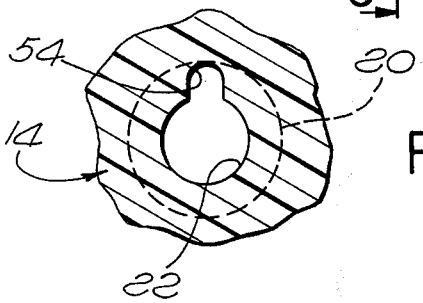
FIG. 3
FIG. 4
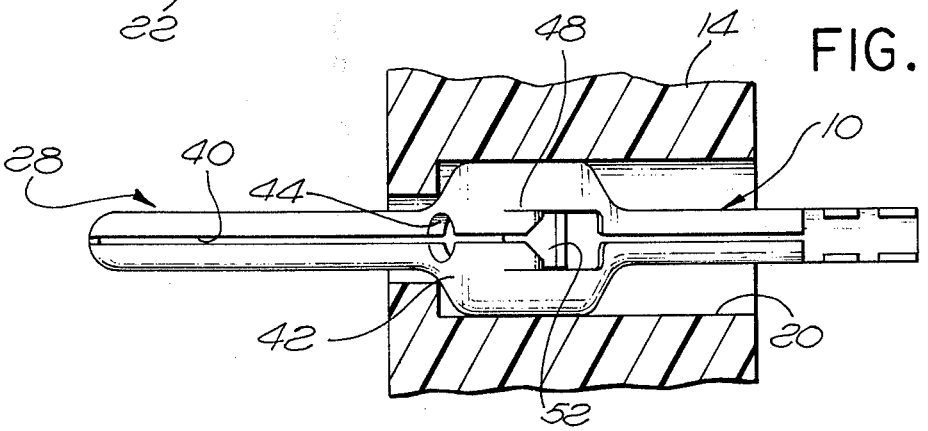

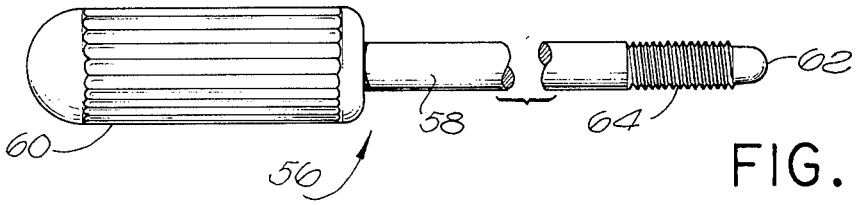
FIG. 5
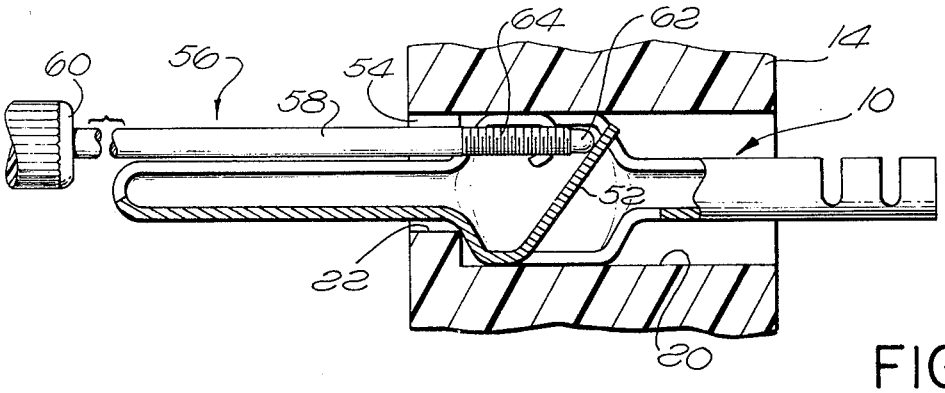
FIG. 6
FIG. 7
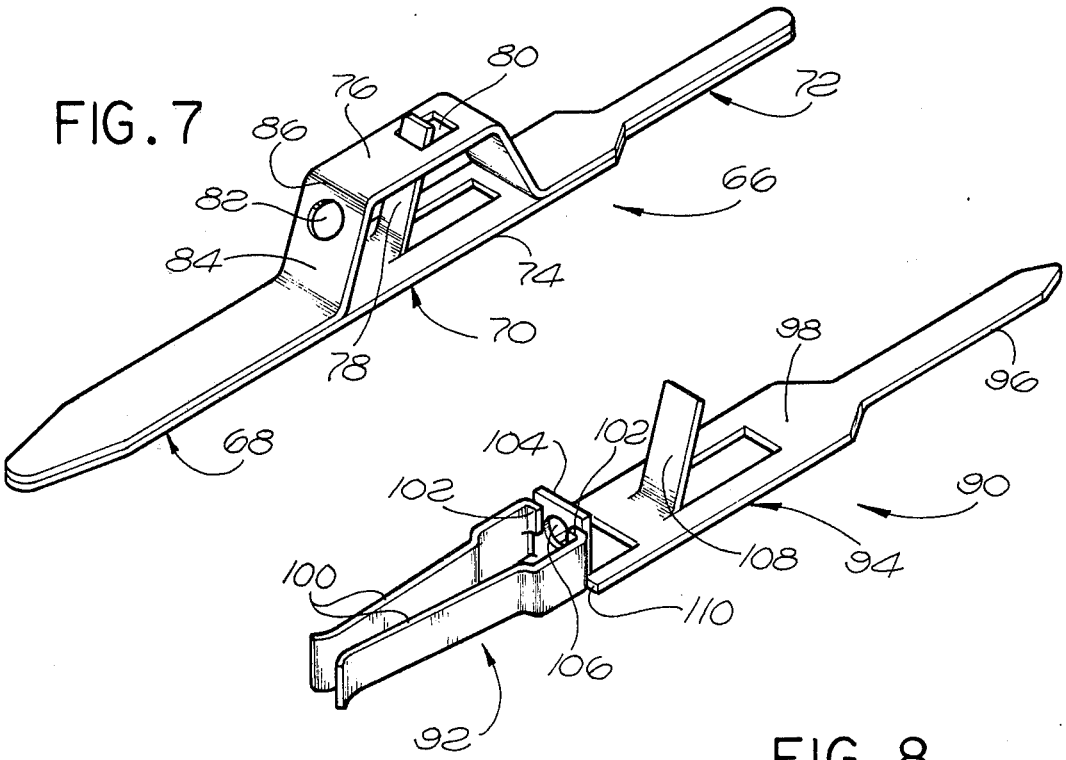
FIG. 8

CONTACT RETENTION ASSEMBLY

BACKGROUND OF THE INVENTION

The present invention relates to an electrical connector and, more particularly, to a contact retention assembly for an electrical connector and to a new contact for use in such an assembly.

It is well known in the art to utilize spring retention tines to releasably retain electrical contacts in insulators of electrical connectors. Typically, a resilient spring tine is stamped from the wall of the contact and bent outwardly and rearwardly of the contact so that the tine will deflect inwardly when the contact is inserted into a contact cavity in an insulator from the rear of the insulator. After the tine passes a rearwardly facing shoulder on the wall of the cavity, the tine springs outwardly to engage the shoulder and thereby restrict rearward movement of the contact in the cavity. Normally such resilient tines are relatively fragile and are easily damaged. For example, when contacts embodying such tines are rolled on a reel for automatic installation in connector insulators, the tines are frequently flattened or deflected inwardly on the contacts so that they are no longer able to spring out to retain the contacts in the cavities in the insulators when they are inserted thereinto. Also, the tines may become flattened or damaged when they are released by an extraction tool. It is the purpose of the present invention to provide an improved contact having a spring retention tine which is less subject to damage than those used in the prior art contacts mentioned above and provides a good retention force.

SUMMARY OF THE INVENTION

According to the principal aspect of the present invention, there is provided a contact retention assembly in which a contact is mounted in a contact cavity of a connector insulator from the rear and is released from the front of the insulator for rear withdrawal of the contact therefrom. The contact embodies a termination section in the cavity which is formed with a spring retention tine that extends at an angle rearwardly and across the cavity to engage the wall of the cavity to limit rearward movement of the contact therein. The spring tine deflects inwardly when the contact is inserted into the cavity from the rear of the insulator and the end of the tine digs into the wall of the cavity when any rearward force is applied to the contact, such as when the forward contacting section of the contact engages a contact on a mating connector member. Means are provided on the retention section of the contact which defines a fixed aperture in front of the spring tine. When it is desired to release the spring tine from its engagement with the wall of the cavity to allow the contact to be withdrawn therefrom, an extraction tool is inserted from the front of the connector insulator into the aperture, and threaded therein so that the end of the tool will engage the tine and deflect it inwardly. The spring tine of the contact of the present invention is more rugged and less easily damaged than the prior art contact retention tines.

BRIEF DESCRIPTION OF THE DRAWINGS

FIG. 1 is a perspective view of a preferred embodiment of the contact of the present invention;

FIG. 2 is a fragmentary, sectional view through a connector insulator showing the contact in FIG. 1 mounted in a contact cavity in the insulator;

FIG. 3 is a fragmentary sectional view taken on line 3—3 of FIG. 2 without the contact mounted therein;

FIG. 4 is a horizontal sectional view taken along line 4—4 of FIG. 2 showing the contact in top elevational view;

FIG. 5 is a side elevational view of the extraction tool utilized for releasing the spring tine of the contact from engagement with the wall of the contact cavity;

FIG. 6 is a fragmentary sectional view similar to FIG. 2 showing the extraction tool of FIG. 5 mounted in position to release the retention tine of the contact;

FIG. 7 is a perspective view of a second embodiment of the contact of the present invention; and FIG. 8 is a perspective view of a further embodiment of the contact of the present invention.

DESCRIPTION OF THE PREFERRED EMBODIMENTS

Referring to FIGS. 1 to 4 of the drawings in detail, there is illustrated the electrical contact of the present invention, generally designated 10, which is mounted in a contact cavity 12 in a connector insulator 14. The cavity extends from the front face 16 to the rear face 18 of the insulator. The cavity comprises an enlarged cylindrical bore 20 which opens at the rear face of the insulator and a smaller diameter bore 22 which is concentric with the bore 20 and opens at the front face 16, defining a rearwardly facing annular shoulder 24 therebetween. Normally the insulator will contain a plurality of cavities 12 each receiving a contact 10.

The contact comprises an electrically conductive body 26 having a forward contacting section 28, an intermediate retention section 30 and a rear termination section 32. The contact body is preferably of one piece construction, and stamped and formed into the desired configuration from sheet metal. Preferably, the forward contacting section 28 of the contact is in the form of a tubular hollow pin, although it could be formed as a hollow cylindrical socket contact. The intermediate retention section 30 of the contact is formed as an enlarged cylindrical hollow hub having a diameter greater than that of the hollow pin 28. The pin is concentric with the hub. The forward portion of the termination section 32 of the contact is also of cylindrical configuration where it joins the hub 30. The rear of the termination section 32 is formed with two pairs of outwardly extending tabs 36 and 38 which may be crimped around a conductor, not shown, inserted into the rear of the contact. While the rear termination section 32 is shown as being a crimp pot, it will be appreciated that any other form of termination could be provided. For example, the termination section 32 could be a solder pot, a wire-wrap post, an insulation-piercing terminal, etc.

A longitudinally extending slot 40, best seen in FIG. 4, extends through the tubular hollow pin 28, the hollow hub 30, and the cylindrical hollow part of the rear termination section 32 of the contact. The enlarged hub 30 defines a forwardly facing annular wall 42 which engages the shoulder 24 in the contact cavity to limit forward movement of the contact therein. The slot 40 is enlarged in the region of the wall 42 on hub 30 to provide a tool-receiving aperture 44. An opening 46 is provided in the hub behind the aperture 44. The aperture and opening are separated by tabs 48 integral with the hub. The rear of the tabs are stamped from the wall of the hub and bent inwardly to provide flanges 50 which serve a purpose which will be seen later. The inwardly bent flanges define the openings 46.

On the opposite side of the hub 30 from the aperture 44 and opening 46, there is provided a spring retention tine 52. The tine is stamped from the lower wall of the hub and bent upwardly therefrom so as to extend laterally across the hub but at a small angle rearwardly of the contact. The end of the tine 52 extends through the opening 46 outside the outer cylindrical surface of the hub.

The contact 10 is inserted into the cavity 12 from the rear face of the insulator 14 and is moved forwardly until the annular wall 42 in the contact engages the shoulder 24 on the cavity wall. During such forward movement on the contact, the spring tine 52 is deflected inwardly by its engagement with the upper surface of the cavity 12 so there is no significant resistance to insertion of the contact into the cavity. Once the contact is fully inserted into the cavity, as illustrated in FIG. 2, any axial force imposed upon the contact causes the end of the tine 52 to dig into the wall of the cavity 12 and thus prevents rearward movement of the contact in the cavity. Such force causing the tine to dig into the wall of the cavity will occur when the connector is engaged with a mating connector member, not shown. The tine also prevents any free rotation of the contact in the cavity 12. The distance that the tine will dig into the wall of the contact cavity is limited by the flanges 50 which function as a stop to prevent excessive gouging of the cavity wall. Because of the transverse orientation of the tine in the contact, it is substantially protected from damage during handling of the contact or when the contact is carried by a carrier strip that is rolled in the form of a reel. The tine will not flatten out as do tines in prior art contacts.

A groove 54 is formed in the upper wall of the bore 22 of the contact cavity and extends from the front face of the insulator 14 to the shoulder 24 in alignment with the aperture 44 in the contact. In order to remove the contact from the cavity 12, an extraction tool as illustrated in FIG. 5, generally designated 56, may be utilized. The tool comprises an elongated rod 58 having a handle 60 on the rear of the rod. The rod has a rounded forward end 62. The area of the rod behind the rounded end is threaded, as indicated at 64. In order to withdraw the contact from the cavity 12, the retention tine must be deflected and held in its deflected position until the tine is free of the cavity wall. To accomplish this, the rod 58 of tool 56 is inserted through the groove 54 in the insulator until the forward end 62 extends into the aperture 44. The tool is then rotated. The threads 64 on the tool engage the sides of the aperture 44 in a manner common to sheet metal nuts, such as Tinnerman nuts. The threaded engagement between the tool and the contact is facilitated by the longitudinal slot 40 in the contact providing a spring action gripping the threaded rod. The tool is threaded through the aperture until the end 62 engages the tine. By further threading of the tool, the end thereof deflects the tine rearwardly in the opening 46 until the end of the tine disengages from the wall of the cavity 12, as seen in FIG. 6. The contact, with the tool threaded therein in the manner just described, is then slid out of the rear of the cavity where the tool may be unthreaded from the contact or vise versa. It will be appreciated that the length of the rod 58 on the tool must be sufficient that it may extend through the insulator with the contact threaded onto the end of the tool.

It is therefore seen that by the use of the threaded tool which engages the sides of the aperture 44 in the contact 10, the tine may be deflected rearwardly relative to the remainder of the contact which is held against axial movement with respect to the tool and the tine will remain in its deflected condition. Thus, a positive release of the retention tine is achieved by the present invention which assures withdrawal of the contact from its contact cavity without damaging the wall of the cavity. As a consequence, the same contact or a new contact may be inserted into the same contact cavity and the retention strength of the contact retention assembly will be retained.

While it is preferred that the end of the tool 56 be threaded, as illustrated in FIG. 5, the tool could have a smooth tapered forward end which self-threads when it is rotated in the aperture 44 in the contact. Release of the retention tine would be achieved in the same fashion as when using the tool 56.

It will be appreciated that the tool in the aperture 44 of the contact "grips" the contact and allows relative rearward deflection of the retention tine to release the tine from the wall of the cavity 12, thereby permitting unrestricted withdrawal of the contact from the cavity. For relatively large contacts, other forms of tools could be utilized. For example, a two-element tool could be utilized in which one element has a hook which extends through the aperture 44 to grip the contact and a second element longitudinally slidable with respect to the first element engages the tine and deflects it rearwardly.

Reference is now made to FIG. 7 of the drawings which illustrates a modified form of the contact of the present invention, generally designated 66. The contact has a forward flat pin contacting section 68, an intermediate retention section 70, and a rear termination section 72. The contact is a two layer construction in which the layers are separated at the intermediate section to provide a lower wall 74 and an upper wall 76. The layers engage each other at the forward pin contacting section 68 and the rear termination section 72. The termination section is shown in the form of a wire-wrap post. A spring retention tine 78 is stamped and bent upwardly from the lower wall 74 of the intermediate section of the contact and bent upwardly through an opening 80 in the upper wall 76. An aperture 82 is formed in a generally vertically extending wall 84 which joins the upper wall 76 to the pin contacting section 78. This contact is adapted to be mounted into a contact cavity of rectangular construction. The upper region 86 of the front wall 84 of the contact will engage a rearwardly facing shoulder in the cavity to limit forward movement of the contact therein. The tine 78 functions to retain the contact in the cavity in the same manner as the tine 52 in the contact 10 described hereinbefore. An extraction tool, such as the tool 56, is inserted through the aperture 82 and threaded to deflect the tine 78 out of engagement with the wall of the cavity to permit rear withdrawal of the contact from the cavity.

FIG. 8 illustrates still a further embodiment of the contact of the present invention, generally designated 90. The contact 90 has a forward contacting section 92, an intermediate retention section 94, and a rear termination section 96 in the form of wire-wrap tail. The intermediate retention section comprises a relatively flat body 98 which is coplanar with the tail 96. The forward contacting section comprises a pair of spring beams 100 which are integral with the flat body 98 and bent up vertically with respect thereto. Inwardly directed tabs 102 are formed on the rear of the spring beams 100. A plate section 104 is stamped from the flat body 98 and bent upwardly against the tabs 102. A tool-receiving aperture 106 is formed in the plate section between the tabs 102. The aperture is aligned with the space between the spring beams 100. A spring retention tine 108 is stamped out of the body 98 behind the plate section 104 and bent upwardly at an angle like the spring retention tine 52 in contact 10. The contact is mounted in a contact cavity in the same fashion as the contacts 10 and 66. Forwardly facing shoulders 110 on the flat body 98, only one being visible in FIG. 8, engage shoulders on the wall of the cavity to limit forward movement of the cavity therein. The contact is withdrawn from the cavity by inserting the tool 56 between the spring beams 100 into the aperture 106, and threading the tool in the aperture to deflect the spring retention tine 108 rearwardly, thereby releasing that tine from the wall of the cavity. Since the plate 104 containing the tool-receiving aperture 106 engages the tabs 102, when the tool is threaded in the aperture forward movement of the plate is resisted and therefore the tool "grips" the contact and allows the tine 108 to be pushed rearwardly relative to the plate 104 and the remainder of the contact.

It will be appreciated that in the broadest aspect of the present invention, a contact is provided in which a spring retention tine extends transversely of the wall of the contact cavity so that the end of the tine will dig into the wall and prevent rearward movement of the contact in the cavity. Stationary means is provided in the contact in front of the spring retention tine that defines an aperture into which a tool may be inserted to grip the contact which allows the retention tine to be moved relative to the contact body and, thus, released from the contact cavity wall. So long as these structural features are embodied in a contact, the contact may have any desired configuration. Of course, the tool-receiving aperture must be accessible from the front of the insulator in which the contact is mounted.

I claim:

1. An electrical connector and extraction tool combination comprising:

an insulator having a front face and a rear face with a contact cavity therein extending from said front face to said rear face;

an electrical contact mounted in said cavity, said contact comprising an electrically conductive body having a forward contacting section and a retention section behind said contacting section;

a spring retention tine on said retention section extending rearwardly at an angle across said cavity to frictionally engage the wall of said cavity, the section of said cavity between said tine and said rear face having a uniform cross-section;

means on said retention section providing a relatively stationary tool-receiving aperture in front of said tine; and an extraction tool insertable from said front face into said aperture to engage said tine whereby said tine will be rearwardly deflected to release its engagement with said cavity wall, said tool embodying means for positively gripping said contact while deflecting said tine so that said tine will remain disengaged from said cavity wall when said contact is withdrawn rearwardly from said cavity.

2. The combination set forth in claim 1 wherein:

said tool comprises a threaded rod threadedly engageable in said aperture.

3. An electrical connector and extraction tool combination comprising:

an insulator having a front face and a rear face with a contact cavity therein extending from said front face to said rear face;

a longitudinally extending groove in the wall of said cavity extending rearwardly from said front face;

an electrical contact mounted in said cavity, said contact comprising an electrically conductive body having a forward contacting section adjacent to said forward face, a rear termination section, and an intermediate retention section inside said cavity;

said intermediate section comprising an enlarged hollow hub defining a forwardly facing wall;

a tool receiving aperture in said wall adjacent to one side of said hub and aligned with said groove;

an opening in the wall of said hub on said one side thereof and located behind said aperture;

a spring retention tine attached to the side of said hub opposite said one side, said tine extending at an angle rearwardly and across said hub through said opening to frictionally engage the wall of said cavity, the section of said cavity between said tine and said rear face having a uniform cross-section;

said tine being aligned with said aperture and said groove; and an extraction tool insertable from said front face through said groove into said aperture to engage said tine whereby said tine will be rearwardly deflected to release its engagement with said cavity wall, said tool embodying means for positively gripping said contact while deflecting said tine so that said tine will remain disengaged from said cavity wall when said contact is withdrawn rearwardly from said cavity.

* * * * *